US006614185B1

(12) United States Patent
Nishimura et al.

(10) Patent No.: US 6,614,185 B1
(45) Date of Patent: Sep. 2, 2003

(54) DISCHARGE TUBE WITH INTERIOR AND EXTERIOR ELECTRODES

(75) Inventors: Kiyoshi Nishimura, Yokosuka (JP); Masuo Shibuya, Yokosuka (JP); Yuichiro Takahara, Yokosuka (JP); Kouichi Honda, Yokosuka (JP)

(73) Assignee: Toshiba Lighting & Technology Corporation, Tokyo (JP)

( * ) Notice: Subject to any disclaimer, the term of this patent is extended or adjusted under 35 U.S.C. 154(b) by 84 days.

(21) Appl. No.: 09/762,407

(22) PCT Filed: Jun. 7, 2000

(86) PCT No.: PCT/JP00/03675

§ 371 (c)(1),
(2), (4) Date: Feb. 7, 2001

(87) PCT Pub. No.: WO00/75961

PCT Pub. Date: Dec. 14, 2001

(30) Foreign Application Priority Data

Jun. 7, 1999 (JP) ..... 11-160200
Dec. 28, 1999 (JP) ..... 11-375817
Mar. 30, 2000 (JP) ..... 2000-095926

(51) Int. Cl.[7] ..... H01J 11/00
(52) U.S. Cl. ..... 313/607; 313/594
(58) Field of Search ..... 313/581, 594, 313/595, 596, 600, 601, 607, 631

(56) References Cited

U.S. PATENT DOCUMENTS 3,649,864 A * 3/1972 Willemsen ..... 313/607
5,101,330 A * 3/1992 Suzuki ..... 313/607
5,382,879 A 1/1995 Council et al. ..... 315/248
5,886,468 A * 3/1999 Terada et al. ..... 313/607
5,889,366 A * 3/1999 Yokokawa et al. ..... 313/607
5,932,960 A 8/1999 Terada et al. ..... 313/485

FOREIGN PATENT DOCUMENTS

| | | | |
|---|---|---|---|
| CA | 2059209 | 8/1992 | ..... H05B/41/24 |
| DE | 69214681 T2 | 11/1996 | ..... H01J/65/04 |
| EP | 0497360 | 8/1992 | ..... H01J/65/04 |
| ES | 2093120 | 12/1996 | ..... H01J/65/04 |
| JP | 02265161 A | 10/1990 | ..... H01J/61/78 |
| JP | 03-225745 | 10/1991 | ..... H01J/65/04 |
| JP | 05041202 A | 2/1993 | ..... H01J/65/00 |
| JP | 07-272694 | 10/1995 | ..... H01J/65/04 |
| JP | 11-025923 | 1/1999 | ..... H01J/65/00 |
| JP | 11-088605 | 3/1999 | ..... H04N/1/04 |
| KR | 95-14133 | 11/1995 | ..... H05B/41/14 |

* cited by examiner

*Primary Examiner*—Vip Patel
(74) *Attorney, Agent, or Firm*—Darby & Darby

(57) ABSTRACT

An internal electrode (14) is formed on the inner wall surface of a tube-shaped light emitting body (12) along the longitudinal direction of the light emitting tube (12). An external electrode (15) is formed on the exterior surface of the light emitting tube (12) along the longitudinal direction of the light emitting tube (12). An electric discharge starts between the internal electrode (14) and the external electrode (15) by applying a high-frequency voltage therebetween. Only one tube wall of the light emitting tube (12) lies between the internal electrode (14) and the external electrode (15), and the internal electrode (14) and the external electrode (15) can be brought close to each other. The limitation of an electric current running between the internal electrode (14) and the external electrode (15) can be reduced, and a starting voltage or a discharge-maintaining voltage can be lowered. In addition, the internal electrode (14) can be easily processed with high accuracy.

18 Claims, 13 Drawing Sheets

DISCHARGE TUBE WITH INTERIOR AND EXTERIOR ELECTRODES

TECHNICAL FIELD

The present invention relates to a discharge lamp, a discharge lamp device using the discharge lamp, and a reader using the discharge lamp device.

BACKGROUND ART

Conventionally, an external electrode type discharge lamp that uses no mercury and is superior in the rise characteristics of a beam of light is known as a discharge lamp used in, for example, an image reader, such as a copying machine or an image scanner, as mentioned in, for example, Published U.S. Pat. No. 2,969,130.

In this discharge lamp, the interior of a tube-shaped light emitting body, such as a glass tube, is filled with a discharge medium, such as xenon, and the outer face of the light emitting tube is provided with a pair of external electrodes in such a way as to face each other, and, by applying a voltage between the pair of external electrodes and passing an electric current through them, the discharge medium discharges in the light emitting tube, thereby outwardly emitting luminous light generated by an electric discharge. A fluorescent layer is formed on the inner wall surface of the light emitting tube, except for the area of an aperture portion between the pair of external electrodes. The fluorescent materials of the fluorescent layer are excited by ultraviolet rays emitted by the electric discharge of the discharge medium, the ultraviolet rays are then converted into visible light, and the visible light is projected outwardly through the aperture portion.

However, in the discharge lamp that uses the pair of external electrodes, two tube walls on both sides of the light emitting tube are placed between the pair of external electrodes, and the tube walls serve to limit an electric current flowing between the external electrodes. Therefore, in order to obtain current by which an electric discharge is activated or lighting is maintained, a high voltage of about 2 to 3 kV and a high frequency of several tens of kilohertz to several hundred kilohertz, for example, are needed for lamp input. Thus, there is a problem in that a high-pressure proofing constituent element needs to be used as a lighting circuit part when the lamp input becomes a high voltage and, in addition, the electrodes to which the high voltage is applied must be coated to be fully insulated. Further, there is another problem in that a high frequency increases the emission of electromagnetic waves and thereby exerts a noise influence upon other electronic equipment although it might be a possible solution to raise a lighting frequency instead of considerably raising the lamp input voltage.

As mentioned in Japanese Unexamined Patent Publication No. 27269 of 1995, there is a discharge lamp in which a shaft-shaped internal electrode is disposed at the center of a cross section of a tube-shaped light emitting body, which has been sealed, along the longitudinal direction of the light emitting tube, and a high frequency voltage is applied between the internal electrode and an external electrode disposed on the outer face of the light emitting tube, thereby discharging between the internal and external electrodes. As the external electrode, use is made of a wire mesh or a metal film impervious to light that is disposed at an area excluding an aperture portion.

However, in the discharge lamp that uses the shaft-shaped internal electrode, only one tube wall of the light emitting tube is placed between the shaft-shaped internal electrode disposed at the center of the cross section of the light emitting tube and the external electrode, and therefore the starting voltage can be lowered more than in a case where a pair of external electrodes are used, but there is a need to dispose the internal electrode at the center of the light emitting tube that is to be sealed. Therefore, the processing accuracy of the sealing must be improved, and, if the processing accuracy is low, characteristic fluctuations will easily occur. Additionally, since there is a need to dispose the shaft-shaped internal electrode at the center of the cross section of the bulb, the path length of an electric discharge cannot be lengthened to ½ or more of the inner diameter of the tube. Therefore, there is a problem in that it is difficult to greatly increase efficiency, and it is difficult to form the internal electrode into a desired shape.

In the discharge lamp that uses the pair of external electrodes and in the discharge lamp that uses the shaft-shaped internal electrode and the metal film impervious to light serving as an external electrode, the fluorescent layer is formed in the area excluding the aperture portion so as to emit light from the aperture portion. Therefore, there is a problem in that the conversion efficiency of ultraviolet rays into visible light is lower than a case where a fluorescent layer is formed on the whole of the inner wall surface of a light emitting tube so as to emit light from the whole of the light emitting tube as in fluorescent lamps used generally, and, in addition, the luminous efficiency is so low that only about 65% of visible light generated in the light emitting tube is emitted out of the light emitting tube.

Accordingly, a possible solution for improving the luminous efficiency of the light emitting tube is to use a transparent conductive film as an external electrode. However, in a conventional discharge lamp whose starting voltage is high, the film thickness of the transparent conductive film needs to be thickened because the electric resistance and loss of the transparent conductive film must be reduced. This leads to a drop in the visible light transmittance of the transparent conductive film, so that the luminous efficiency cannot be expected to be fully improved. And, in the discharge lamp mentioned in Japanese Unexamined Patent Publication No. 27269 of 1995, the metal mesh is used as an external electrode. However, the metal mesh is at a disadvantage in that adhesion between the glass of the light emitting tube and the metal mesh is bad, and a slight electric discharge occurs in the outer face of the light emitting tube, and, in addition, dust adheres to the mesh.

The present invention was made in view of these respects, and it aims to provide a discharge lamp capable of being easily manufactured, capable of reducing lamp voltage, such as a starting voltage or a discharge maintaining voltage, and capable of improving the luminous efficiency, to provide a discharge lamp device using the discharge lamp, and to provide a reader using the discharge lamp device.

DISCLOSURE OF THE INVENTION

A discharge lamp of the present invention comprises a tube-shaped light emitting body, a discharge medium enclosed in the light emitting tube, an internal electrode formed on an inner wall surface of the light emitting tube along a longitudinal direction of the light emitting tube, and an external electrode disposed outside the light emitting tube along the longitudinal direction of the light emitting tube. Since the internal electrode is formed on the inner wall surface of the light emitting tube, and the external electrode is disposed outside the light emitting tube, only one tube wall of the light emitting tube lies between the internal electrode and the external electrode, and therefore the limitation of an electric current running between the internal electrode and the external electrode can be reduced, and a lamp voltage, such as a starting voltage or a discharge-maintaining voltage, can be lowered. Further, since the internal electrode is formed on the inner wall surface of the light emitting tube, it can be easily processed with high accuracy. Further, since the internal electrode is disposed on the inner wall surface of the light emitting tube, the internal electrode and the external electrode can be arranged to create a desired relationship of being close to or away from each other.

Presumably, an electric discharge first starts where the distance between the internal electrode and the external electrode is shortest, and an electric-discharge path length is gradually lengthened when a voltage is applied therebetween. This fact explains that the starting voltage can be reduced.

Further, the internal electrode and the external electrode are placed so that at least part of them overlaps with each other with a tube wall of the light emitting tube therebetween. Since at least a part of the internal electrode and the external electrode overlaps with each other with tube wall of the light emitting tube therebetween, the distance therebetween can be made shortest, and the lamp voltage, such as starting voltage or discharge-maintaining voltage, can be lowered.

Further, the light emitting tube has an aperture portion through which a beam of light generated by an electric discharge in the light emitting tube is emitted to the outside, and the internal electrode is formed at one side of the aperture portion, and the external electrode is formed at a position excluding the aperture portion. Since the internal electrode is formed at one side of the aperture portion, and the external electrode is formed at the position excluding the aperture portion, the distance between the internal electrode and the external electrode can be shortened, and the lamp voltage, such as starting voltage or discharge-maintaining voltage, can be lowered.

Further, the internal electrode and the external electrode have a relationship of facing to each other with a sectional center of the light emitting tube therebetween. Since the internal electrode and the external electrode have the relationship of facing to each other with a sectional center of the light emitting tube therebetween, a positive column that passes through the sectional center of the light emitting tube between the internal electrode and the external electrode can be generated, and the luminous efficiency can be improved.

Further, an auxiliary external electrode that is not electrically connected to the external electrode is disposed outside the light emitting tube and in the vicinity of the internal electrode. Since the auxiliary external electrode that is not electrically connected to the external electrode is disposed outside the light emitting tube and in the vicinity of the internal electrode, electric power is supplied among the internal electrode, the external electrode, and the auxiliary external electrode, for example, when actuated, and therefore an electric discharge can be easily generated between the internal electrode and the auxiliary external electrode, and the starting voltage can be lowered.

Further, the external electrode has a transparent conductive film. Since the lamp voltage of the discharge lamp is lowered, the transparent conductive film that is thin in film thickness can be used as an external electrode, and the luminous efficiency can be improved.

Further, the external electrode has a primary conductive portion that is impervious to light, the primary conductive portion being connected to the transparent conductive film, with at least part of the primary conductive portion overlapping with the internal electrode with the tube wall of the light emitting tube therebetween. Since the external electrode has the primary conductive portion that is impervious to light, the primary conductive portion being connected to the transparent conductive film, with at least part of the primary conductive portion overlapping with the internal electrode with the tube wall of the light emitting tube therebetween, an electric discharge can be easily generated between the internal electrode and the primary conductive portion when actuated, and the electric resistance and loss of the external electrode can be reduced by using the primary conductive portion and the transparent conductive film together as an external electrode.

Further, the relation of $0.6<S\cdot T$ is created, where S is an aperture ratio excluding the primary conductive portion of the outer wall surface of the light emitting tube, and T is transmissivity of the transparent conductive film. If $0.6<S\cdot T$, luminous efficiency that exceeds that of the discharge lamp having the aperture portion can be obtained.

Further, a discharge lamp of the present invention comprises a light emitting tube, a discharge medium enclosed in the light emitting tube, and a pair of internal electrodes formed to face each other with a sectional center of the light emitting tube therebetween along a longitudinal direction of the light emitting tube. Since the pair of internal electrodes are formed to face each other with the sectional center of the light emitting tube therebetween along the longitudinal direction of the light emitting tube, the tube wall of the light emitting tube does not lie between the internal electrodes, and the limitation of an electric current running between the internal electrodes can be reduced. In addition, the lamp voltage, such as starting voltage or discharge-maintaining voltage, can be lowered, and the internal electrode can be easily processed with high accuracy. In addition, a positive column that passes through the sectional center of the light emitting tube can be generated between the pair of internal electrodes, and the luminous efficiency can be improved.

An edge of at least one of the internal electrodes is ruggedly formed. Since the edge of at least one of the internal electrodes is ruggedly formed, an electric discharge stably concentrates on the convex part of the rugged portion when the electric field strength of the convex part of the electrode rises, and flickering can be prevented.

Further, a dielectric layer is formed on the inner wall surface of the light emitting tube so as to cover the internal electrode. Since the dielectric layer is formed on the inner wall surface of the light emitting tube so as to cover the internal electrode, the internal electrode can be prevented from sputtering because of an electric discharge, and the lifetime of the lamp can be lengthened.

Further, the dielectric layer is made up of a plurality of layers different from each other in softening-point. Since the dielectric layer is made up of a plurality of layers different from each other in softening-point, an electrode material is prevented from diffusing into an outer dielectric layer by an inner dielectric layer whose softening point is higher than that of the outer dielectric layer by making the softening point of the inner dielectric layer directly covering the internal electrode higher than that of the outer dielectric layer covering the inner dielectric layer when the outer dielectric layer is melted and burned, for example. The outer dielectric layer can be formed as a layer that has fewer pinholes and has a uniform film, and a withstand voltage of the dielectric layer can be secured, and the lamp life can be improved.

Further, the dielectric layer is covered with an electron emitting layer. Since the dielectric layer is covered with the electron emitting layer, the emission of electrons into the interior of the light emitting tube is facilitated by the electron emitting layer, and an electric discharge under the condition of a low lamp voltage can be allowed even if a dielectric layer is formed to cover the internal electrode.

Further, a discharge lamp device of the present invention comprises a discharge lamp provided with an auxiliary external electrode, and a lighting device for supplying electric power among the internal electrode, the external electrode, and the auxiliary external electrode of the discharge lamp when actuated and supplying electric power between the internal electrode and the external electrode after being actuated. Since the discharge lamp is provided with the auxiliary external electrode, and, by the lighting device, electric power is supplied among the internal electrode, the external electrode, and the auxiliary external electrode of the discharge lamp when actuated, and electric power is supplied between the internal electrode and the external electrode after being actuated, the electric discharge is easily carried out between the internal electrode and the auxiliary external electrode when actuated, and the starting voltage can be lowered.

Further, a discharge lamp device of the present invention comprises a discharge lamp, and a lighting device for lighting the discharge lamp with the external electrode of the discharge lamp as a grounding potential. Since the discharge lamp is lighted by the lighting device with the external electrode of the discharge lamp as the grounding potential, a high-potential external electrode is not disposed outside the light emitting tube, and the insulation process of the external electrode can be facilitated, and the generation of noise can be reduced.

The lighting device applies a direct-current pulse voltage in which the internal electrode is set to be a cathode side. Since the direct-current pulse voltage in which the internal electrode is set to be a cathode side is applied by the lighting device, the influence of ion collision upon the internal electrode can be reduced, and the lifetime of the lamp can be lengthened.

Further, a reader of the present invention comprises a carriage, a discharge lamp device in which at least a discharge lamp is mounted in the carriage, and a light receiving means for receiving reflected light from a projecting surface from which a beam of light of the discharge lamp is projected. The above-mentioned discharge lamp is applicable as a discharge lamp having a long electric-discharge path length like the reader.

BEST MODE FOR CARRYING OUT THE INVENTION

Embodiments of the present invention will be described hereinafter with reference to the attached drawings.

Figure 1:
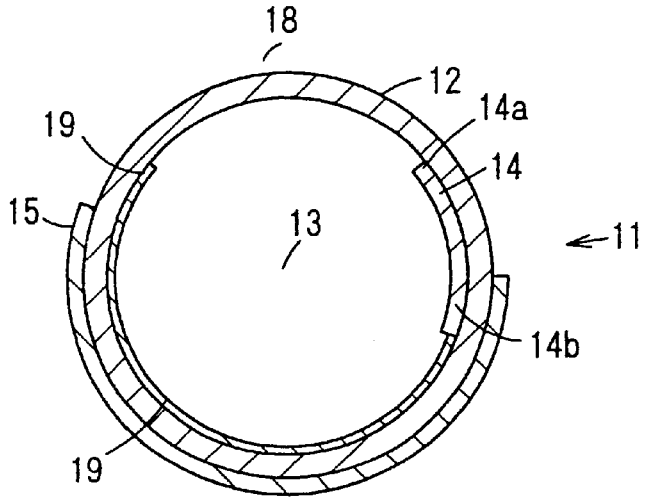
FIG. 1 is a cross-sectional view of a discharge lamp according to a first embodiment of the present invention.
Figure 2:
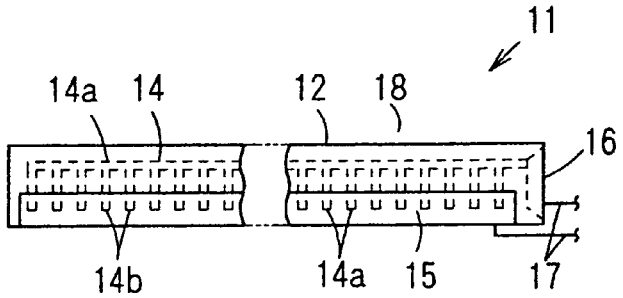
FIG. 2 is a side view of the discharge lamp.
Figure 3:
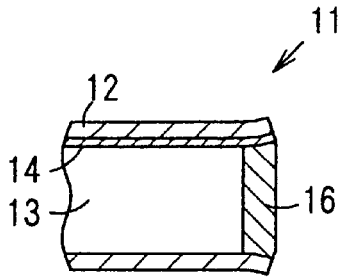
FIG. 3 is an enlarged sectional view of a part of the discharge lamp.
Figure 4:
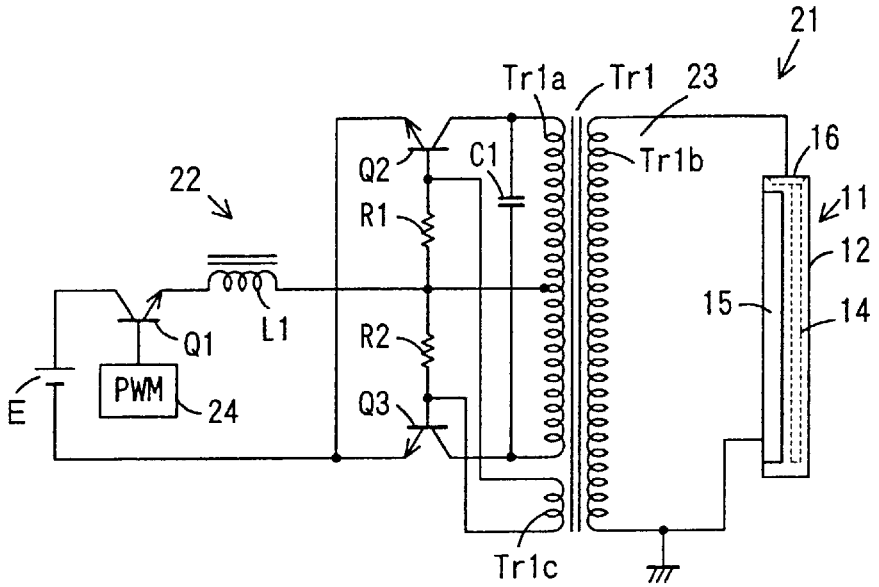
FIG. 4 is a circuit diagram of a discharge lamp device using the discharge lamp.

A first embodiment of the present invention is shown in FIG. 1 to FIG. 4. FIG. 1 is a cross-sectional view of a discharge lamp, FIG. 2 is a side view of the discharge lamp, FIG. 3 is an enlarged sectional view of a part of the discharge lamp, and FIG. 4 is a constructional diagram of a discharge lamp device using the discharge lamp.

Referring to FIGS. 1 and 3, a discharge lamp 11 has a long bulb 12 as a tube-shaped light emitting body. The bulb 12 is made from translucent materials, such as lead glass, leadless glass, borosilicate glass, quartz glass, or translucent ceramics, and is formed cylindrically. The diameter of the tube is about 6 to 30 mm, the length thereof is about 200 to 450 mm, and the wall thickness thereof is about 0.5 mm. Both ends of the tube are sealed. The reason why the tube diameter is within the range of 6 to 30 mm is that luminous efficiency cannot be expected if less than 6 mm, and the effect of voltage reduction cannot markedly appear because of an increase in an electric-discharge path length if more than 30 mm.

A discharge space 13 is formed in the bulb 12, and is filled with rare gas composed largely of, for example, xenon (Xe) under a pressure of about 5 to 40 kPa. Krypton, argon, neon, helium, or nitrogen may be used as a discharge medium instead of xenon. Herein, at least one of them is used, or some of them are mixed and used.

An internal electrode 14 is formed directly on the inner wall surface of the bulb 12. The internal electrode 14 is about 3 μm in film thickness, and about 3.0 mm in width which corresponds to the circumferential direction of the bulb 12. The internal electrode 14 has a continuous part 14*a* formed along the longitudinal direction of the bulb 12, and has a plurality of convex parts 14*b* that ruggedly project from the continuous part 14*a* in the circumferential direction, i.e., like the teeth of a comb. The internal electrode 14 is formed such that an electrode material, such as aluminum, and a small amount of glass frit are dispersed to an organic binder, a film on which a pattern is formed by printing is then stuck onto the inner surface of the bulb 12, the bulb is then burned in the atmosphere within the range of 450 to 600° C. so as to evaporate a film component and a binder component, and the electrode is stuck fast to the inner wall surface of the bulb 12. Alternatively, it is formed by printing by the use of a silver paste. From the viewpoint of durability and electrical characteristics, it is desirable that the internal electrode 14 be 0.5 mm or more in width and, in consideration of the light shading of the internal electrodes 14, be within the range of 180° or less, preferably 90° or less, of the cross section of the bulb 12.

An external electrode 15 is disposed on the outer wall surface of the bulb 12 along the longitudinal direction (axial direction) of the bulb 12. The external electrode 15 is formed by printing that uses a silver paste or by adhering an aluminum tape. Part of the external electrode 15 is arranged to overlap with the convex parts 14*b* of the internal electrode 14 with the tube wall of the bulb 12 therebetween.

As shown in FIG. 3, a conductive, metallic end plate (a sealing metal of an iron-nickel-chromium alloy, for example) 16 and the internal electrode 14 are electrically connected to each other when both end openings of the bulb 12 are sealed with the end plate 16, thus allowing the internal electrode 14 to be electrically connected to the outside of the bulb 12.

Electric supply terminals are each welded beforehand onto the end plate 16 that is electrically connected to the internal electrode 14 and onto the external electrode 15. Lead wires 17 are connected to the electric supply terminals, respectively.

A partial area in the bulb 12, which is situated between the internal electrode 14 and the external electrode 15 and is extended along the longitudinal direction of the bulb 12, is defined as an aperture portion 18 through which rays of light generated by an electric discharge in the bulb 12 are emitted to the outside.

A fluorescent layer 19 is formed in an area of the inner surface of the bulb 12 excluding the area occupied by both the aperture portion 18 and the internal electrode 14. The fluorescent layer 19 is about 50 μm, for example, in film thickness, and is made from any one of fluorescent materials of, for example, red R, green G, and blue B, or is made from three-wavelength fluorescent materials of red R, green G, and blue B. Rare-earth metal fluorescent materials are usable as the three-wavelength fluorescent materials. For example, an europium activation yttria fluorescent material (Y,Gd) $BO_3$:Eu is for red, an europium activation alkali earth metal aluminate fluorescent material $BaMg_2Al_{16}O_{27}$:Eu is for green, and a cerium/terbium co-activation rare earth metal phosphate fluorescent material $LaPO_4$:Ce,Tb is for blue. Preferably, the fluorescent layer 19 is not formed on the internal electrode 14 including the adjoining convex parts 14*b*. The reason is that, if it is formed on the internal electrode 14, the fluorescent layer 19 turns into a dielectric, and the fluorescent layer 19 will be easily cracked, thus exerting an influence upon electric discharge.

FIG. 4 shows a discharge lamp device 21. The discharge lamp device 21 has the discharge lamp 11 and a lighting device 22 that turns on the discharge lamp 11. The lighting device 22 applies a high frequency voltage having a peak voltage of, for example, about 1 kV and a frequency of about 70 kHz between the internal electrode 14 and the external electrode 15 of the discharge lamp 11.

A constant-current push-pull inverter 23 is connected to the lighting device 22 through a transistor Q1 that constructs a chopping circuit in a direct-current power supply E. A driving circuit 24 for adjusting the PWM (Pulse Width Modulation) control of the chopping circuit is connected to the base of the transistor Q1. One end of a choking coil L1 is connected to the emitter of the transistor Q1, and the bases of a pair of transistors Q2 and Q3 are connected to the other end of the choking coil L1 through resistors R1 and R2. The intermediate point of a primary winding Tr1*a* of an isolation transformer Tr1 is also connected to the other end of the choking coil L1. A resonant capacitor C1 that resonates with an inductive component of the primary winding Tr1*a* of the isolation transformer Tr1 is connected to the primary winding Tr1*a* of the isolation transformer Tr1. Ends of a feedback winding Tr1*c* of the isolation transformer Tr1 are connected to the bases of the transistors Q2 and Q3, respectively, and the transistors Q2 and Q3 perform self-oscillation by the output from the feedback winding Tr1*c*. The external electrode 15 of the discharge lamp 11 is connected to the grounding side of a secondary winding Tr1*b* of the isolation transformer Tr1, and the internal electrode 14 is connected to the high-potential side thereof.

A sine wave is applied to the discharge lamp 11 by the oscillation of the constant-current push-pull inverter 23 so as to turn on the discharge lamp 11 with high frequency. The input to the constant-current push-pull inverter 23 varies by allowing the transistor Q1 of the chopping circuit to undergo PWM control, and, by this PWM control, the discharge lamp 11 is adjusted.

An electric discharge between the internal electrode 14 and the external electrode 15 is generated by applying a high frequency voltage between the internal electrode 14 and the external electrode 15 of the discharge lamp 11. Electrons passed by the electric discharge excite a discharge medium, such as xenon, enclosed in the bulb 12, so that ultraviolet rays of 172 nm are emitted from xenon molecules. The ultraviolet rays excite the fluorescent materials of the fluorescent layer 19, and the ultraviolet rays are converted into visible light. The visible light is emitted to the outside through the aperture portion 18.

The electric discharge in the bulb 12 is carried out such that, in the case of DC pulse lighting, the electric discharge starts at a place where the internal electrode 14 on the cathode side and the external electrode 15 on the anode (ground) side are close to each other when the device is actuated, and, as the bulb 12 is charged up, the electric discharge is gradually extended to a part of the external electrode 15 distant from the internal electrode 14, so that the electric-discharge distance becomes long. Especially, since the internal electrode 14 has the plurality of convex parts 14*b*, the electric discharge occurs concentratedly in the convex parts 14*b* when the electric field strength of each convex part 14*b* rises. As the lighting device, use may be made of a device that outputs AC pulses, sine waves, etc., without becoming limited to one that is turned on by DC pulses. It is preferable to perform pulse lighting so as to obtain high illuminance.

In the thus constructed discharge lamp 11, the internal electrode 14 is disposed on the inner wall surface of the bulb 12, and the external electrode 15 is disposed on the exterior surface of the bulb 12. Therefore, only one tube wall of the bulb 12 lies between the internal electrode 14 and the external electrode 15, and the electric discharge can be started from a part where the internal electrode 14 and the external electrode 15 are close to each other, so that the limitation of an electric current passed through the internal electrode 14 and the external electrode 15 can be reduced, and lamp voltage, such as starting voltage or discharge-maintaining voltage, can be reduced. Thus, the reduction of both the lamp input voltage and the frequency makes it possible to lessen the emission of electromagnetic waves and, therefore, reduce the influence of noise upon other electronic equipment. Further, the internal electrode 14 can be easily and precisely processed to be disposed on the inner wall surface of the bulb 12.

Further, since part of each of the internal electrode 14 and the external electrode 15 are formed to overlap with each other with the tube wall of the bulb 12 therebetween, the distance between the internal electrode 14 and the external electrode 15 can be made shortest, and lamp voltage, such as starting voltage or discharge-maintaining voltage, can be reduced.

Further, since the internal electrode 14 is formed at one side position of the aperture portion 18 of the bulb 12, and the external electrode 15 is formed at the position excluding the aperture portion 18, the distance between the internal electrode 14 and the external electrode 15 can be shortened, and lamp voltage, such as starting voltage or discharge-maintaining voltage, can be reduced.

Further, since the edge of the internal electrode 14 that faces the external electrode 15 is ruggedly formed, the electric discharge is stably concentrated at the convex parts 14*b* when the electric field strength of the convex parts 14*b* of the internal electrode 14 is raised. Thus, it is possible to prevent flickering. A similar effect can be obtained when the edge of the external electrode 15 is ruggedly formed.

Further, since the discharge lamp 11 is lit by the lighting device 22 using the external electrode 15 of the discharge lamp 11 as a grounding potential, a high-potential external electrode 15 is not situated outside the bulb 12, and therefore the external electrode 15 can be easily subjected to an insulation process, and the occurrence of noise can be reduced.

Further, since a DC pulse voltage in which the internal electrode 14 is defined as a cathode side is applied by the lighting device 22, the influence of ion collision with the internal electrode 14 can be reduced, and a lamp life can be increased.

Further, since the discharge lamp according to the present embodiment uses rare gas as a discharge medium, the lamp is not subject to ambient temperature, and rise characteristics are excellent, and therefore the lamp is the most suitable illumination device for an image reader. Further, since the lamp is excellent in low-temperature characteristics and does not have mercury that exerts an influence upon the environment, the lamp is suitable as a display device for automobile use. Further, the light emitted from the discharge lamp is not limited to visible light, and may be vacuum ultraviolet rays of 172 nm, which is the emission of xenon molecules, or may be ultraviolet rays of other wavelengths that are converted by fluorescent materials. The discharge lamp serving as an ultraviolet light source is usable as a light source for photo-catalytic excitation.

Figure 5:
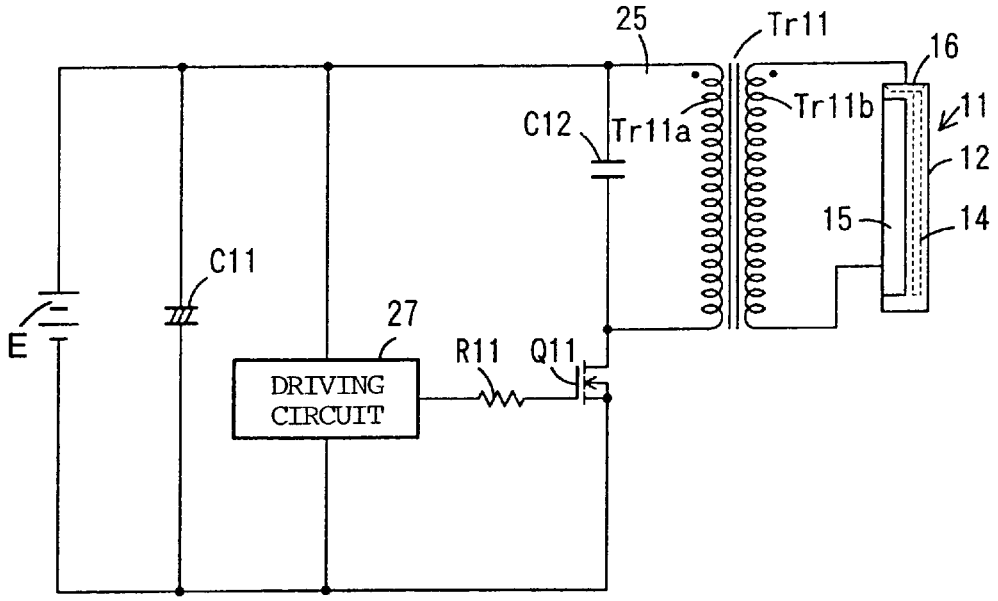
FIG. 5 is a circuit diagram of a discharge lamp device using a discharge lamp according to a second embodiment.

Next, a second embodiment of the present invention will be described with reference to FIG. 5. FIG. 5 is a circuit diagram of a discharge lamp device using the discharge lamp.

In a lighting device 22 of the discharge lamp device 21, a smoothing capacitor C11 is connected in parallel with a DC (direct-current) power supply E, and a one-type inverter circuit 25 is connected to the capacitor C11. The inverter circuit 25 is made up of a parallel resonant circuit 26 including a primary winding Tr11*a* of an insulation type boosting inverter transformer Tr11 and a capacitor C12 connected in parallel with the primary winding Tr11*a*, and a series circuit with a field-effect transistor Q11 serving as a switching element. The inverter circuit 25 is connected in parallel with the capacitor C11.

A driving circuit 27 is connected to the gate of the field-effect transistor Q11 through a resistor R11.

The external electrode 15 of the discharge lamp 11 is connected to the anode side of a secondary winding Tr11*b* of the inverter transformer Tr11, and the internal electrode 14 is connected to the cathode side thereof.

A direct current of the DC power supply E is smoothed by the capacitor C11, and then supplied to the inverter circuit 25. In the inverter circuit 25, the field-effect transistor Q11 is turned on and off by the driving circuit 27, and oscillations are generated by the inductance of the inverter transformer Tr11 and by the capacitance of the capacitor C12, and a direct-current pulse voltage with the internal electrode 14 as a cathode side is applied to the discharge lamp 11 so as to light the discharge lamp 11 with high frequency according to a direct-current pulse lighting method.

Thus, since the DC pulse voltage with the internal electrode 14 as the cathode side is applied by the lighting device 22, the influence of ion collision upon the internal electrode 14 can be reduced, and the lamp life can be improved.

Figure 6:
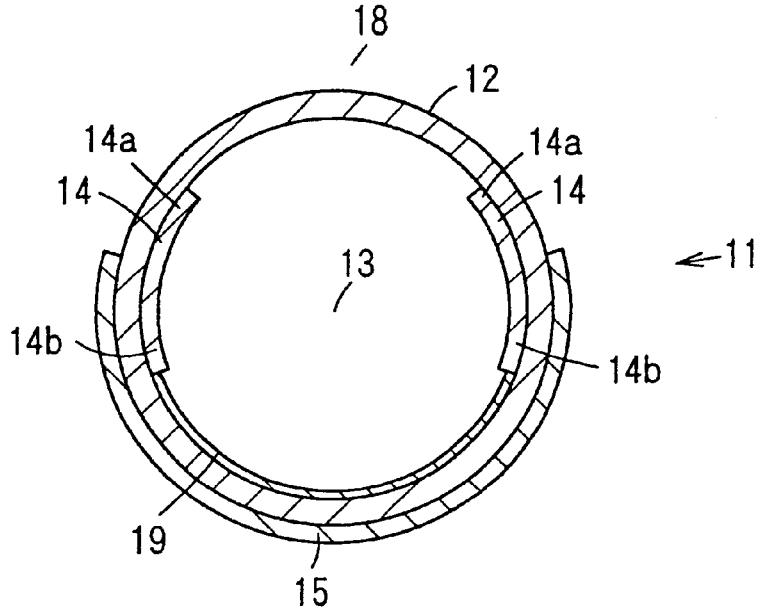
FIG. 6 is a cross-sectional view of a discharge lamp according to a third embodiment.

Next, a third embodiment of the present invention will be described with reference to FIG. 6. FIG. 6 is a cross-sectional view of a discharge lamp.

A plurality of internal electrodes 14 are formed apart from each other on the inner wall surface of the bulb 12. In this example, the internal electrodes 14 are formed as a pair, and are correspondingly placed at both ends of the aperture portion 18. A fluorescent layer 19 is formed between the internal electrodes 14, and an external electrode 15 is formed so as to overlap with each of the internal electrodes 14. The internal electrodes 14 are electrically connected to each other, and maintain the same potential.

The electric discharge in the bulb 12 is carried out such that, in the case of DC pulse lighting (for example, rectangular waveform, saw-tooth waveform, half-sine waveform, or triangular waveform, that has quiescent sections), the electric discharge starts simultaneously at two places where the internal electrode 14 and the external electrode 15 are close to each other when actuated, and, as the bulb 12 is charged up, the electric discharge is gradually extended to a part of the external electrode 15 distant from the internal electrode 14. Therefore, the starting voltage can be leveled, and the discharge-maintaining voltage can be reduced.

The internal electrodes 14 may be three or more in number.

Figure 7:
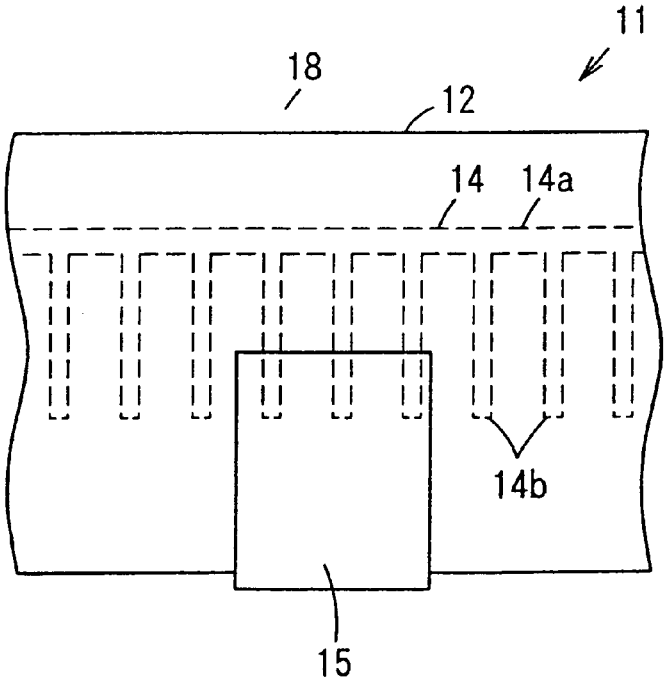
FIG. 7 is a side view of a part of a discharge lamp according to a fourth embodiment.

Next, a fourth embodiment of the present invention will be described with reference to FIGS. 7 and 8. FIG. 7 shows a side view of a part of a discharge lamp, and FIG. 8 shows a constructional diagram of a discharge lamp device using the discharge lamp.

A plurality of external electrodes 15 (only one of them is shown in FIG. 7) are formed in parallel along the longitudinal direction of a bulb 12, and the discharge lamp 11 for display can be constructed by selectively varying the aperture portions 18 of the one discharge lamp 11.

The external electrode 15 is about 10 mm, for example, in width in the longitudinal direction of the bulb 12, and is about 30 mm, for example, in pitch in the longitudinal direction of the bulb 12. Each position of the aperture portions 18 corresponding to the external electrodes 15 functions as a light emitting portion from which light is emitted.

Figure 8:
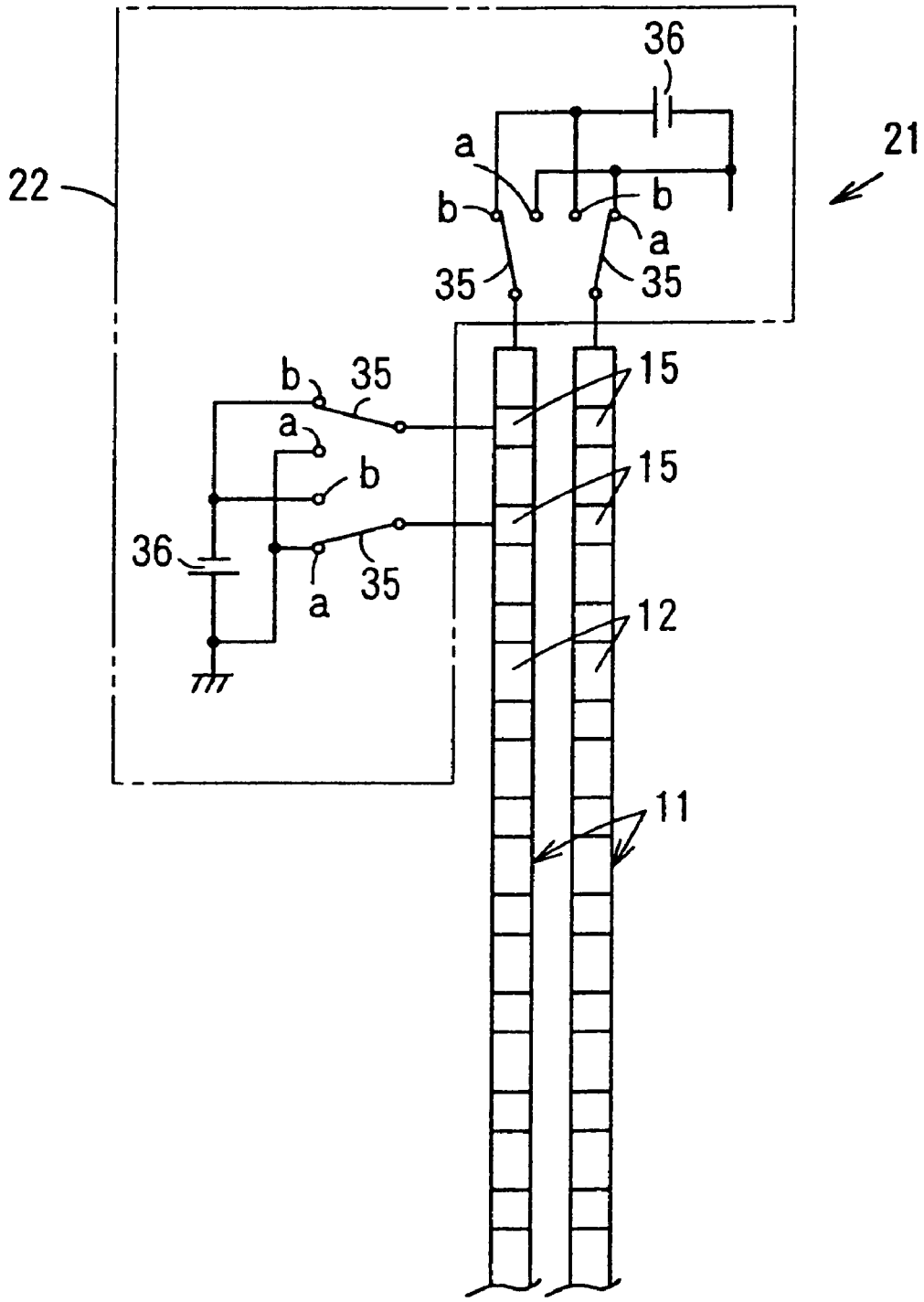
FIG. 8 is a schematic view of a discharge lamp device using the discharge lamp.

FIG. 8 shows the discharge lamp device 21. The discharge lamp device 21 has the discharge lamps 11 and a lighting device 22 that turns on the discharge lamps 11. The lighting device 22 applies a high frequency voltage having a peak voltage of, for example, about 1 kV and a frequency of about 70 kHz between the internal electrode 14 and the external electrode 15.

The lighting device 22 includes a switching circuit 35 that connects the internal electrode 14 of each discharge lamp 11 and each external electrode 15 to power supply sides a, b. With respect to the internal electrode 14 and each external electrode 15, the switching circuit 35 switches between the power supply side a to which a high-frequency voltage that is the discharge-maintaining voltage or more and does not reach the starting voltage (discharge starting voltage) is applied and the power supply side b provided with a power supply 36 that is connected in series with the high-frequency voltage and raises the high-frequency voltage to the starting voltage or more.

With the external electrode 15 of the discharge lamp 11 as a grounding potential, the lighting device 22 applies a pulse voltage in which the internal electrode 14 is fixed as a cathode side, and the external electrode 15 is fixed as an anode side.

Thereafter, a high-frequency voltage that is the starting voltage or greater is applied to the internal electrode 14 of the discharge lamp 11 through the power supply side b by the switching of the switching circuit 35, and a high-frequency voltage that is the starting voltage or greater is applied to the external electrode 15 of the discharge lamp 11 through the power supply side b by the switching of the switching circuit 35. As a result, since the high-frequency voltage that is the starting voltage or greater is applied between the internal electrode 14 and the external electrode 15, the electric discharge of a discharge medium in the bulb 12 starts. After the electric discharge starts, each of the switching circuits 35 switches so as to apply the high-frequency voltage that is the discharge-maintaining voltage or more and does not reach the starting voltage onto the internal electrode 14 and the external electrode 15 through the power supply side a. The electric discharge in the bulb 12 is maintained even in the switched state.

The thus constructed discharge lamp 11 can constitute a large display device such that a position that corresponds to each external electrode 15 is defined as a pixel, and a plurality of discharge lamps 11 are arranged in parallel so as to form a display surface. In this case, the discharge lamps 11 that individually have fluorescent layers 19 of red R, green G, and blue B are arranged in parallel as a pair, thereby enabling the color displaying of information about characters or video images.

A sheet light source can be constructed by arranging a plurality of discharge lamps in parallel, as in the first embodiment shown by FIGS. 1 to 4, and lighting them simultaneously. It will be possible to furnish a liquid crystal display device provided with a back light that is sufficiently thin and has highly-effective illuminance if the sheet light source is used as the back light of the liquid crystal display device.

Figure 9:
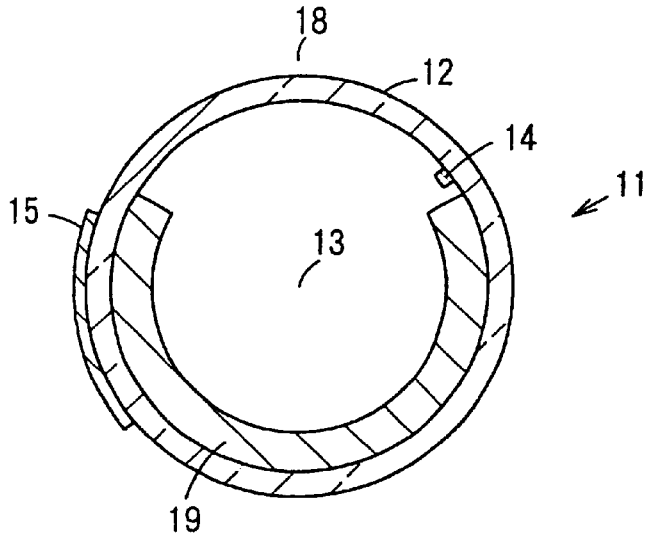
FIG. 9 is a cross-sectional view of a discharge lamp according to a fifth embodiment.

Next, a fifth embodiment of the present invention will be described with reference to FIGS. 9 and 10. FIG. 9 is a cross-sectional view of a discharge lamp, and FIG. 10 is a characteristic diagram showing the relationship between the input electric power and brightness of the discharge lamp.

As shown in FIG. 9, a bulb 12 having, for example, an outer tube diameter of 16 mm, an inner tube diameter of 15 mm, and a tube length of 400 mm is used as the discharge lamp 11. An internal electrode 14 formed on the inner wall surface of the bulb 12 and an external electrode 15 formed on the outer wall surface thereof are disposed to face each other with the sectional center of the bulb 12 therebetween.

By forming the internal electrode 14 and the external electrode 15 so as to face each other with the sectional center of the bulb 12 therebetween in this way, a positive column that passes through the sectional center of the bulb 12 occurs between the internal electrode 14 and the external electrode 15, and the percentage of the positive column in the discharge space 13 increases. The increase of the positive column allows xenon atoms, for example, enclosed in the discharge space 13 to excite efficiently so as to increase the emission of ultraviolet rays of 172 nm, and the increase of the ultraviolet rays heightens the excitation of a fluorescent layer 19 so as to improve the luminous efficiency.

Figure 10:
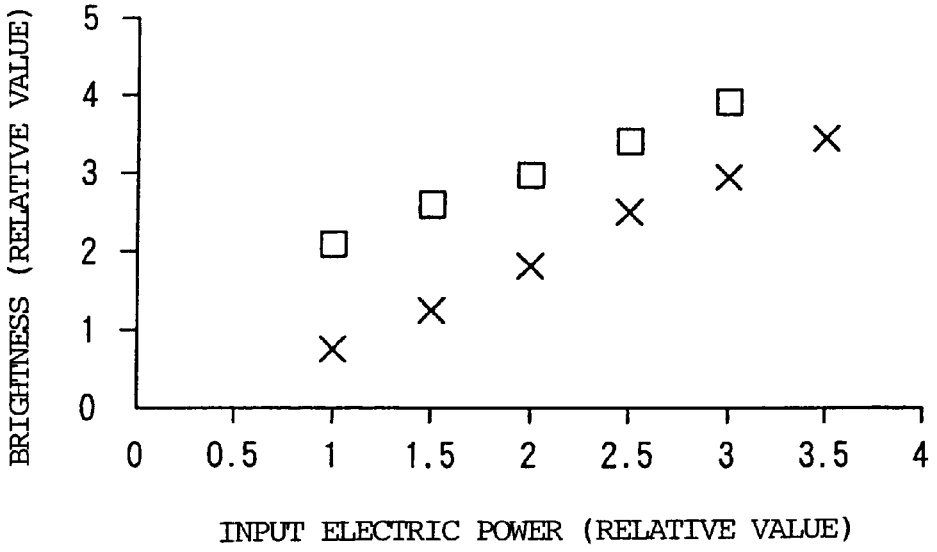
FIG. 10 is a characteristic diagram showing the relationship between the input electric power and brightness of the discharge lamp.

FIG. 10 shows a result of lighting examinations made in the discharge lamp 11 in which the positive column that passes through the sectional center of the bulb 12 occurs as in this embodiment, and, as a comparative example, made in the discharge lamp in which, for example, a creeping discharge occurs along the inner wall surface of the bulb 12 without the occurrence of the positive column that passes through the sectional center of the bulb 12. The sign " " in FIG. 10 indicates the examination result of the discharge lamp 11 in this embodiment, and the sign "x" indicates the examination result in the comparative example. As a result, it was ascertained that brightness is improved, regardless of the input electric power, in the case in which the positive column which passes through the sectional center of the bulb 12 occurs between the internal electrode 14 and the external electrode 15 that face each other like the discharge lamp 11 in this embodiment more than in the case of the comparative example.

Concerning a condition under which the most suitable positive column occurs in the discharge space 13 of the interior of the bulb 12, it is preferable that the value $d \times p$ be 30000 or less where d(cm) is the inner diameter of the bulb 12 and p(Pa) is the charged pressure of a discharge medium into the bulb 12. If it is more than 30000, the positive column will shrink, thus causing unstableness easily.

Figure 11:
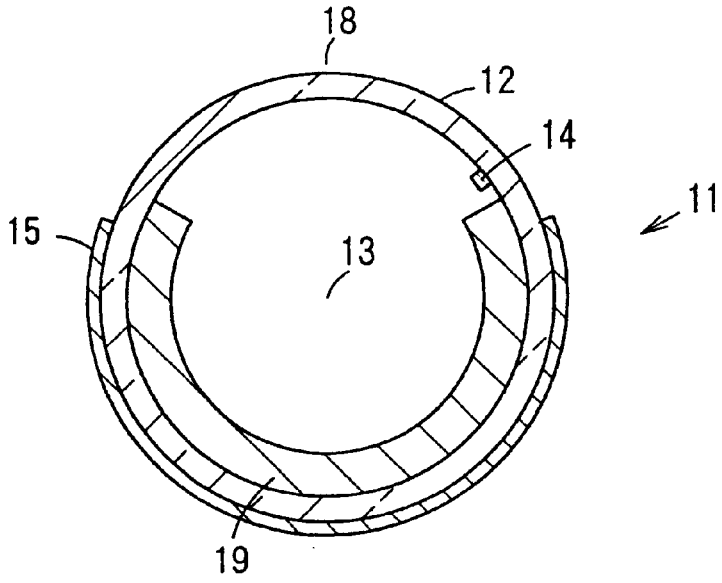
FIG. 11 is a cross-sectional view of a discharge lamp according to a sixth embodiment.

Next, a sixth embodiment of the present invention will be described with reference to FIG. 11. FIG. 11 is a cross-sectional view of a discharge lamp.

When the internal electrode 14 and the external electrode 15 are formed to face each other with the sectional center of the bulb 12 therebetween like the discharge lamp 11 of FIG. 9, the starting voltage has a tendency to rise.

In such cases, if the edge of the external electrode 15 opposite to the side of the aperture portion 18 is extended to the neighborhood of the internal electrode 14 as shown in FIG. 11, the distance between the internal electrode 14 and the external electrode 15 can be shortened, thus reducing the starting voltage.

Figure 12:
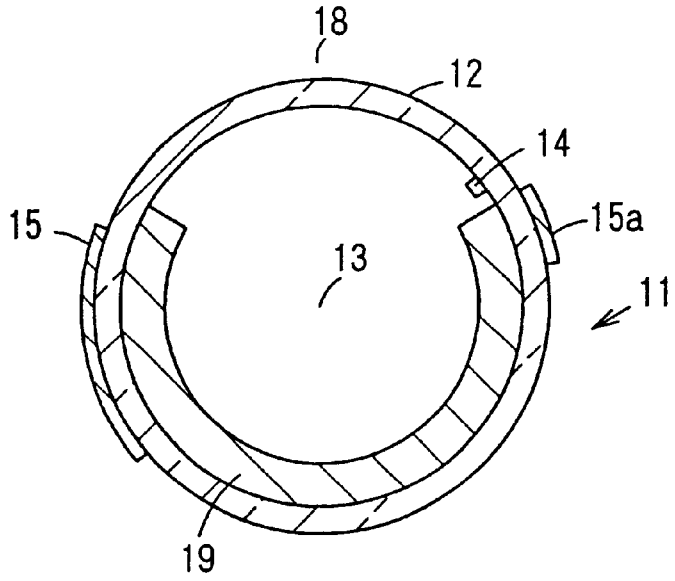
FIG. 12 is a cross-sectional view of a discharge lamp according to a seventh embodiment.

Next, a seventh embodiment of the present invention will be described with reference to FIG. 12. FIG. 12 is a cross-sectional view of a discharge lamp.

An auxiliary external electrode 15*a* that is not connected electrically to the external electrode 15 is disposed in the neighborhood of the internal electrode 14 on the outer wall surface of the bulb 12 as shown in FIG. 12, and electric power is supplied among the internal electrode 14, the external electrode 15, and the auxiliary external electrode 15*a* of the discharge lamp 11 by the lighting device 22 only when actuated. Thereby, an electric discharge easily occurs between the internal electrode 14 and the auxiliary external electrode 15*a*, and the electric discharge is enlarged between the internal electrode 14 and the external electrode 15 while acting as a pilot flame, thus reducing the starting voltage.

In the discharge lamp 11 provided with the auxiliary external electrode 15*a* and in the discharge lamp 11 that is not provided with the auxiliary external electrode 15*a*, a starting voltage Vs that is exhibited when light is emitted by gradually increasing the starting voltage was measured. As a result, Vs=1.3 kV in the discharge lamp 11 provided with the auxiliary external electrode 15*a*, and Vs=1.6 kV in the discharge lamp 11 that is not provided with the auxiliary external electrode 15*a*. That is, the starting voltage was reduced more in the discharge lamp 11 provided with the auxiliary external electrode 15*a* than in the discharge lamp 11 that is not provided therewith.

After being actuated, electric power is supplied only between the internal electrode 14 and the external electrode 15 of the discharge lamp 11 by the lighting device 22. As a result, as in the discharge lamp 11 of FIG. 9, a positive column that passes through the sectional center of the bulb 12 occurs between the internal electrode 14 and the external electrode 15 that face each other, and the luminous efficiency can be improved.

Figure 13:
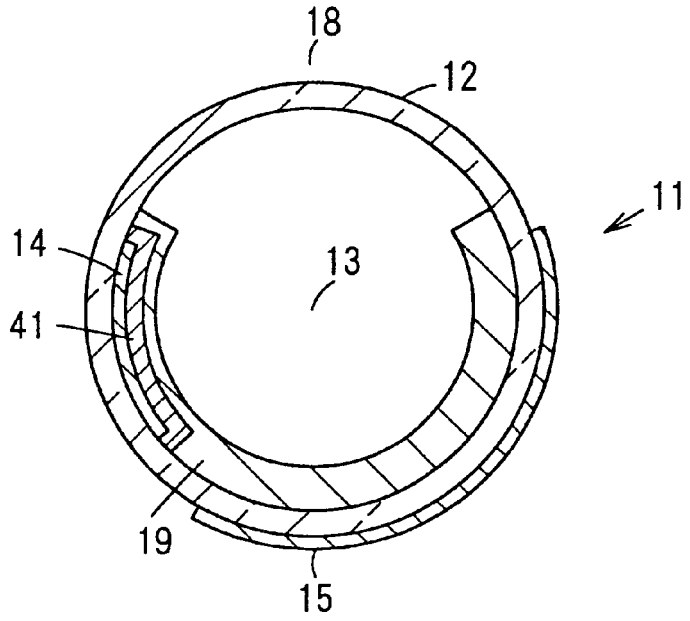
FIG. 13 is a cross-sectional view of a discharge lamp according to an eighth embodiment.

Next, an eighth embodiment of the present invention will be described with reference to FIG. 13. FIG. 13 is a cross-sectional view of a discharge lamp.

A dielectric layer 41 made of, for example, lead glass is formed to cover the internal electrode 14 on the inner wall surface of the bulb 12. A fluorescent layer 19 is formed on this dielectric layer 41.

The dielectric layer 41 is formed such that a glass frit with a low melting point of 450° C., for example, and a small amount of binder are dispersed to an organic solvent or a water-soluble solvent, they are then applied to cover the internal electrode 14 on the inner wall surface of the bulb 12, a binder component is then removed by heating the bulb 12 in the atmosphere, and the glass frit is melted by further heating it to a high temperature. Thereafter, the melted glass frit is enlarged uniformly to form the dielectric layer 41 whose surface is smooth.

Since the dielectric layer 41 is formed to cover the internal electrode 14, the internal electrode 14 can be prevented from being sputtered because of the electric discharge in the bulb 12, and the lamp life can be improved. Since the dielectric layer 41 is a thin film, less influence is exerted upon the starting voltage or the discharge-maintaining voltage.

The dielectric layer 41 with a low melting point is used in order to smooth its surface. If it is not even but rugged, the electric discharge concentrates and becomes unstable, and the dielectric layer 41 is subjected to sputtering, so that the internal electrode 14 is bared. The electric discharge concentrates on the bared internal electrode 14, and, as a result, the fear that the bulb 12 will be cracked is aroused.

If the dielectric layer 41 is white, it can act as a reflective layer, and brightness can be improved. In order to make the dielectric layer 41 white, use is made of a glass frit mixed with fine particles of titanium oxide or magnesium oxide. Thereby, the dielectric layer 41 becomes white, and its reflectance becomes high.

Figure 14:
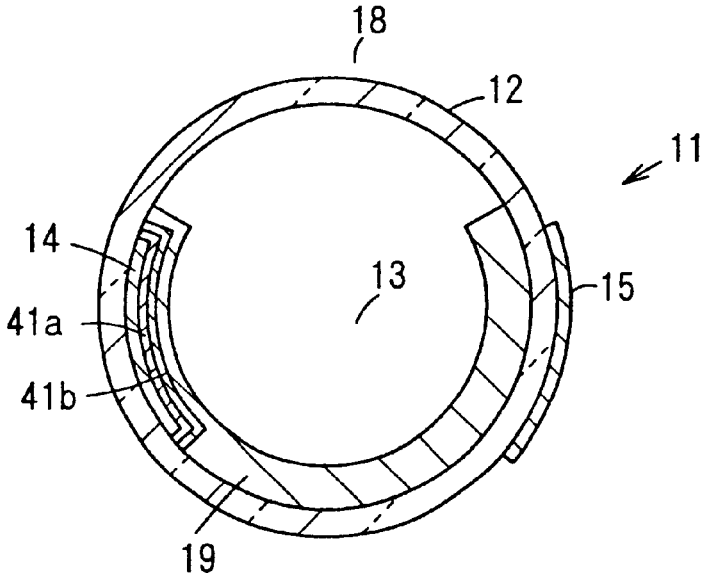
FIG. 14 is a cross-sectional view of a discharge lamp according to a ninth embodiment.

Next, a ninth embodiment of the present invention will be described with reference to FIG. 14. FIG. 14 is a cross-sectional view of a discharge lamp.

A plurality of dielectric layers with different softening points may be formed on the inner wall surface of the bulb 12 of the discharge lamp 11. In more detail, a first dielectric layer 41*a* is formed to cover the internal electrode 14 on the inner wall surface of the bulb 12, and a second dielectric layer 41*b* with a melting point lower than that of the first dielectric layer 41*a* is formed to cover the first dielectric layer 41*a*. These dielectric layers 41*a* and 41*b* are made of the same material as the dielectric layer 41 according to the same procedure.

In order to form the dielectric layers 41*a* and 41*b*, a glass frit with a high melting point of 600° C., for example, and a small amount of binder are first dispersed into an organic solvent or a water-soluble solvent and are applied to cover the internal electrode 14 on the inner wall surface of the bulb 12, the bulb 12 is then heated in the atmosphere so as to remove the binder component, and it is burned at 550° C. As a result, the first dielectric layer 41*a* is formed. Subsequently, a glass frit with a low melting point of 500° C., for example, and a small amount of binder are dispersed into an organic solvent or a water-soluble solvent, and are applied to cover the internal electrode 14 on the inner wall surface of the bulb 12, the bulb 12 is then heated in the atmosphere so as to remove the binder component, and it is further heated to a high temperature of 550° C., for example, so as to melt the glass frit with the low melting point. As a result, the second dielectric layer 41*b* is formed. Thereafter, the melted glass frit is smoothly enlarged, and the second dielectric layer 41*b* with an even surface is formed.

When the glass frit with the low melting point of the second dielectric layer 41*b* is melted and burned, a burning temperature is set to be lower than the melting point of the first dielectric layer 41*a* and to be higher than the melting point of the second dielectric layer 41*b*. As a result, the glass frit with the high melting point of the first dielectric layer 41*a* is not melted, and only the glass frit with the low melting point of the second dielectric layer 41*b* is melted. Therefore, electrode materials precipitated from the internal electrode 14 by the first dielectric layer 41*a* can be prevented from diffusing into the second dielectric layer 41*b*, and the second dielectric layer 41*b* can be formed as a film that has fewer pinholes and has an even surface. Additionally, the withstand voltage of the second dielectric layer 41*b* can be secured, and the lamp life can be improved.

Figure 15:
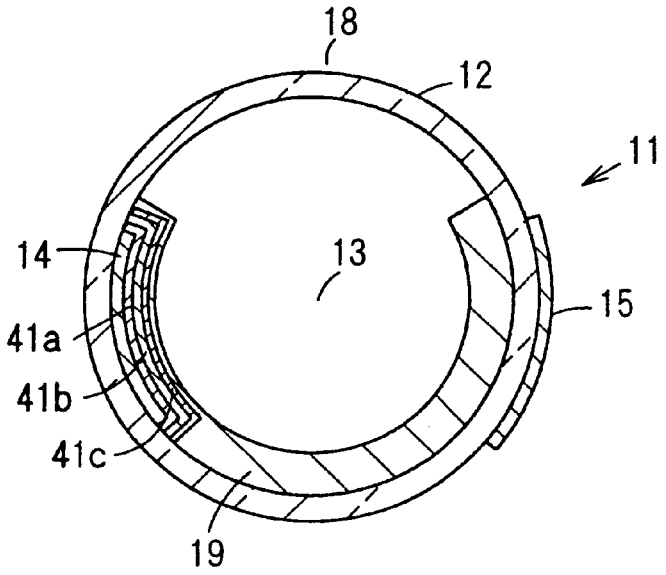
FIG. 15 is a cross-sectional view of a discharge lamp according to a tenth embodiment.

Next, a tenth embodiment of the present invention will be described with reference to FIG. 15. FIG. 15 is a cross-sectional view of a discharge lamp.

As in the discharge lamp 11 of FIG. 14, a first dielectric layer 41*a* is formed to cover the internal electrode 14 on the inner wall surface of the bulb 12 of the discharge lamp 11, and a second dielectric layer 41*b* with a melting point lower than that of the first dielectric layer 41*a* is formed to cover the first dielectric layer 41*a*, and, in addition, a third dielectric layer 41*c* with a melting point higher than that of the second dielectric layer 41*b* is formed to cover the second dielectric layer 41*b*. A fluorescent layer 19 is formed on the third dielectric layer 41*c*.

In order to form the third dielectric layer 41*c*, the dielectric layers 41*a* and 41*b* are first formed in such a way as above, and thereafter a glass frit with a high melting point of 600° C., for example, and a small amount of binder are dispersed into an organic solvent or a water-soluble solvent and are applied to cover the internal electrode 14 on the inner wall surface of the bulb 12, the bulb 12 is then heated in the atmosphere so as to remove the binder component. As a result, the third dielectric layer 41*c* is formed. A burning temperature at this time is lower than the melting point of the dielectric layer 41*b*.

When the fluorescent layer 19 is formed on the second dielectric layer 41*b* whose surface is smooth, the melted dielectric layer 41*b* and the fluorescent layer 19 are mixed with each other so that ultraviolet rays cannot reach the fluorescent layer 19 because the burning temperature of the fluorescent layer 19 is higher than the melting point of the dielectric layer 41*b*, and therefore the emissive power decreases markedly. However, the mixture of the fluorescent layer 19 and the dielectric layer 41*b* can be prevented by forming the third dielectric layer 41*c*.

Figure 16:
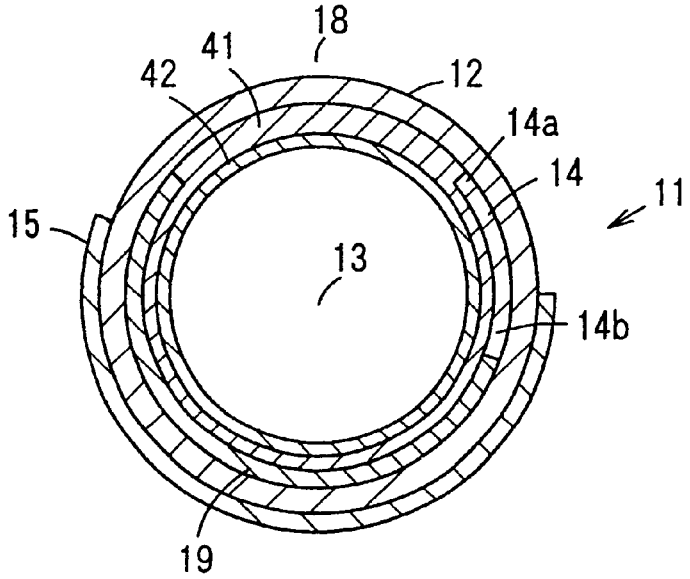
FIG. 16 is a cross-sectional view of a discharge lamp according to a eleventh embodiment.

Next, an eleventh embodiment of the present invention will be described with reference to FIG. 16. FIG. 16 is a cross-sectional view of a discharge lamp.

An electron emitting layer 42 that is made of electron emitting materials, such as MgO, $Al_2O_3$, $Ce_2O_3$, $Mn_2O_3$, or $LaB_6$, that have a high electron emission rate, as well as the internal electrode 14, the fluorescent layer 19, and the dielectric layer 41, is formed to cover the dielectric layer 41 on the inner wall surface of the bulb 12 of the discharge lamp 11. The electron emitting layer 42 has a film thickness penetrable by light.

The dielectric layer 41 that has been formed to cover the internal electrode 14 causes the reduction of the electron emission to the interior of the bulb 12. However, the electron emitting layer 42 facilitates the electron emission thereto, thus allowing electric discharge under the condition of a low starting voltage or a low discharge-maintaining voltage.

As another example instead of this embodiment, a metal oxide layer covering the internal electrode 14 may be formed on the inner wall surface of the bulb 12 of the discharge lamp 11, and a dielectric layer 41 with a melting point lower than that of the metal oxide layer may be formed on the metal oxide layer.

The materials of the metal oxide layer include at least one of aluminum oxide, titanium oxide, silicon oxide, yttrium oxide, lanthanum oxide, and magnesium oxide. The film thickness of the metal oxide layer is about 1 $\mu$m when that of the internal electrode 14 is about 3 $\mu$.

The metal oxide layer is formed such that fine alumina particles with a particle diameter of, for example, 100 nm or less and a small amount of binder are dispersed into an organic solvent or a water-soluble solvent, thereafter they are applied to cover the internal electrode 14 on the inner wall surface of the bulb 12, and the bulb 12 is heated in the atmosphere so as to remove the binder component.

In order to form the dielectric layer 41, after the metal oxide layer is formed, a glass frit with a low melting point of 450° C., for example, and a small amount of binder are dispersed into an organic solvent or a water-soluble solvent, thereafter they are applied to cover the metal oxide layer on the inner wall surface of the bulb 12, thereafter the bulb 12 is heated in the atmosphere so as to remove a binder component, and the bulb 12 is further heated to a high temperature so as to melt the glass frit having the low melting point. As a result, the dielectric layer 41 is formed. The melted glass frit is uniformly enlarged, and, as a result, the dielectric layer 41 having a smooth surface is formed.

When the dielectric layer 41 is melted and burned, a burning temperature is set to be higher than the melting point of the dielectric layer 41 and to be lower than the melting point of the metal oxide layer. As a result, the metal oxide layer is not melted, and only the glass frit with the low melting point of the dielectric layer 41 is melted. Therefore, electrode materials precipitated from the internal electrode 14 by the metal oxide layer can be prevented from diffusing into the dielectric layer 41, and the dielectric layer 41 can be formed as a film that has fewer pinholes and has an even surface. Additionally, the withstand voltage of the dielectric layer 41 can be secured, and the lifetime of the lamp can be lengthened.

Figure 17:
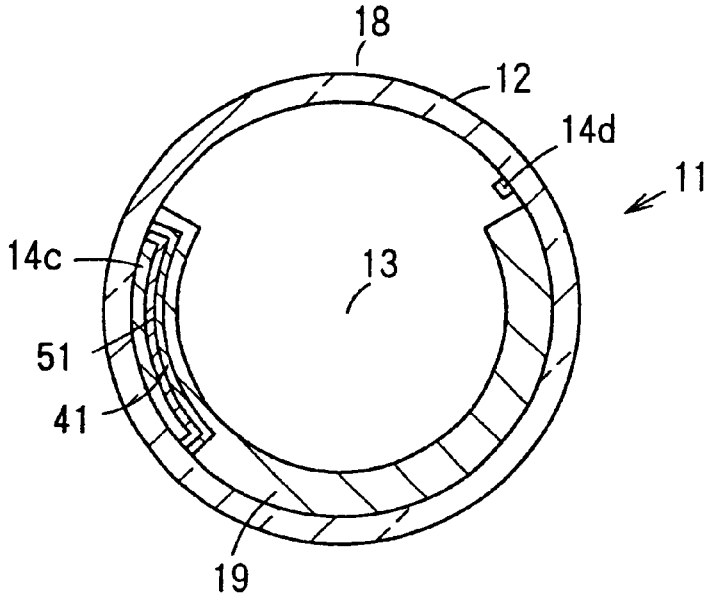
FIG. 17 is a cross-sectional view of a discharge lamp according to a twelfth embodiment.

Next, a twelfth embodiment of the present invention will be described with reference to FIG. 17. FIG. 17 is a cross-sectional view of a discharge lamp.

A pair of internal electrodes 14*c* and 14*d* are formed on the inner wall surface of the bulb 12, and the internalelectrodes 14*c* and 14*d* face each other with the sectional center of the bulb 12 therebetween.

Since the pair of internal electrodes 14*c* and 14*d* are formed on the inner wall surface of the bulb 12 in this way, the tube wall of the bulb 12 is not situated between the internal electrodes 14*c* and 14*d*. Therefore, the limitation of an electric current passed between the internal electrodes 14*c* and 14*d* can be reduced, and the starting voltage or the discharge-maintaining voltage can be reduced.

Further, since the pair of internal electrodes 14*c* and 14*d* are formed to face each other with the sectional center of the bulb 12 therebetween, a positive column that passes through the sectional center of the bulb 12 occurs between the internal electrodes 14*c* and 14*d*, and the percentage of the positive column in the discharge space 13 increases. The increase of the positive column allows xenon atoms, for example, enclosed in the discharge space 13 to efficiently excite so as to increase the emission of ultraviolet rays of 172 nm, and the increase of the ultraviolet rays heightens the excitation of a fluorescent layer 19 so as to improve the luminous efficiency.

The internal electrode 14*c* is covered with the above-mentioned metal oxide film 51 and the dielectric layer 41, and the other internal electrode 14*d* is exposed to the discharge space 13. In this state, in the lighting device 22, a pulse voltage is applied in which the internal electrode 14*d*is set to function as a grounding potential and is further set to function as a cathode side, and the internal electrode 14*c* is set to function as an anode side. Accordingly, the influence of ion collision upon the internal electrode 14*d* exposed thereto can be reduced, and the lamp life can be improved.

Further, since an electric discharge is carried out not through the external electrode 15 but through the relatively thin dielectric layer 41, the discharge-maintaining voltage can be lowered more than the case in which the bulb wall is used as a dielectric, and the bulb 12 is not subject especially to the constraint of such a dielectric.

Figure 18:
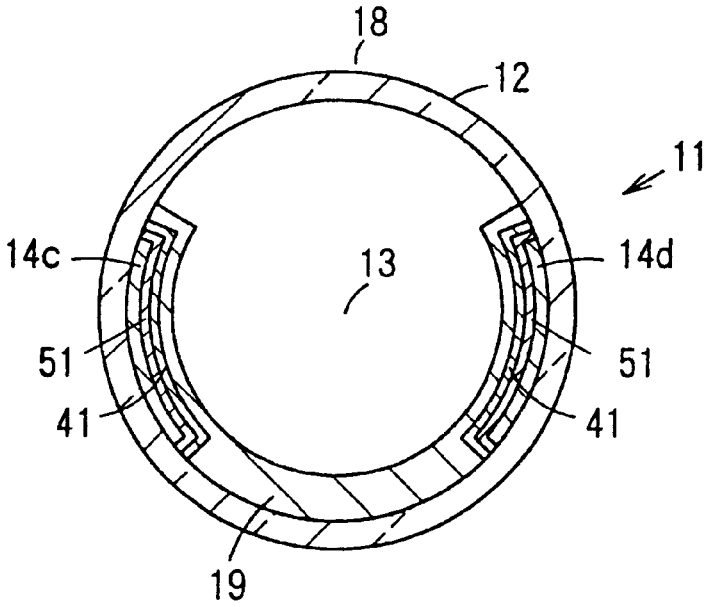
FIG. 18 is a cross-sectional view of a discharge lamp according to a thirteenth embodiment.

Next, a thirteenth embodiment of the present invention will be described with reference to FIG. 18. FIG. 18 is a cross-sectional view of a discharge lamp.

Both internal electrodes 14*c* and 14*d* are each covered with the metal oxide film 51 and the dielectric layer 41.

Therefore, the influence of ion collision can be reduced, and the lifetime of the lamp can be lengthened.

Figure 19:
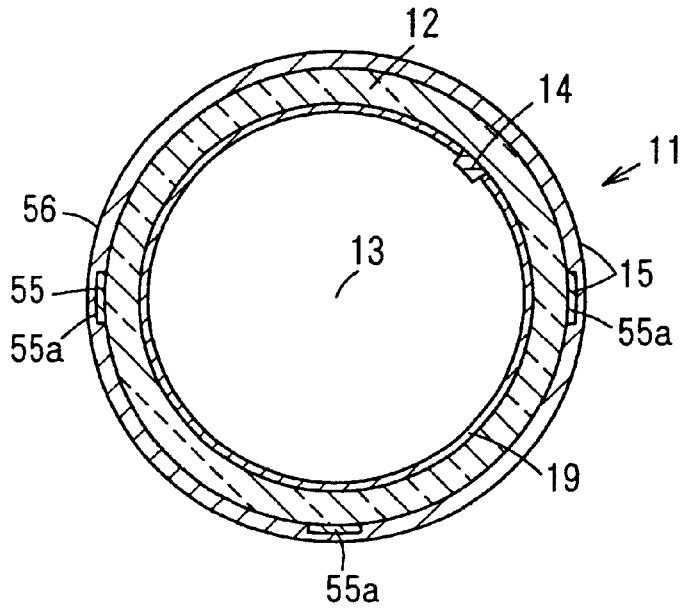
FIG. 19 is a cross-sectional view of a discharge lamp according to a fourteenth embodiment.

Next, a fourteenth embodiment of the present invention will be described with reference to FIGS. 19 to 21. FIG. 19 is a cross-sectional view of a discharge lamp, FIG. 20 is a side view of a part of the discharge lamp, and FIG. 21 is a characteristic diagram showing the relationship between the aperture ratio and transmittance of the discharge lamp.

Figure 20:
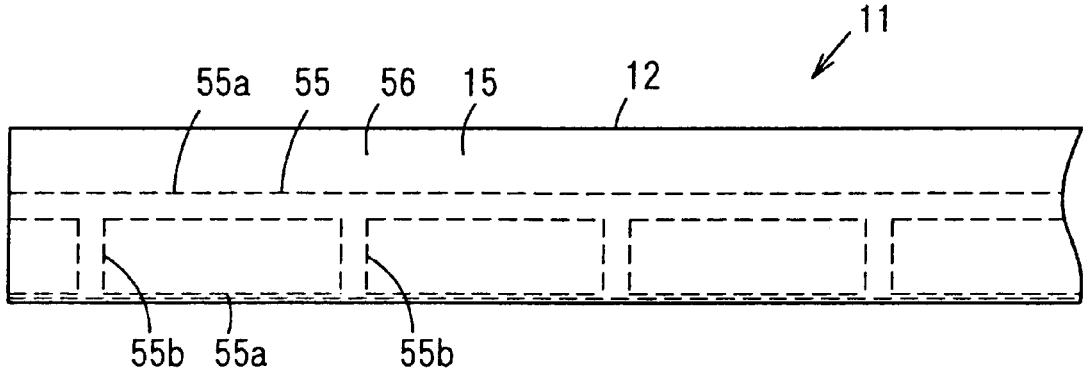
FIG. 20 is a side view of a part of the discharge lamp.
Figure 21:
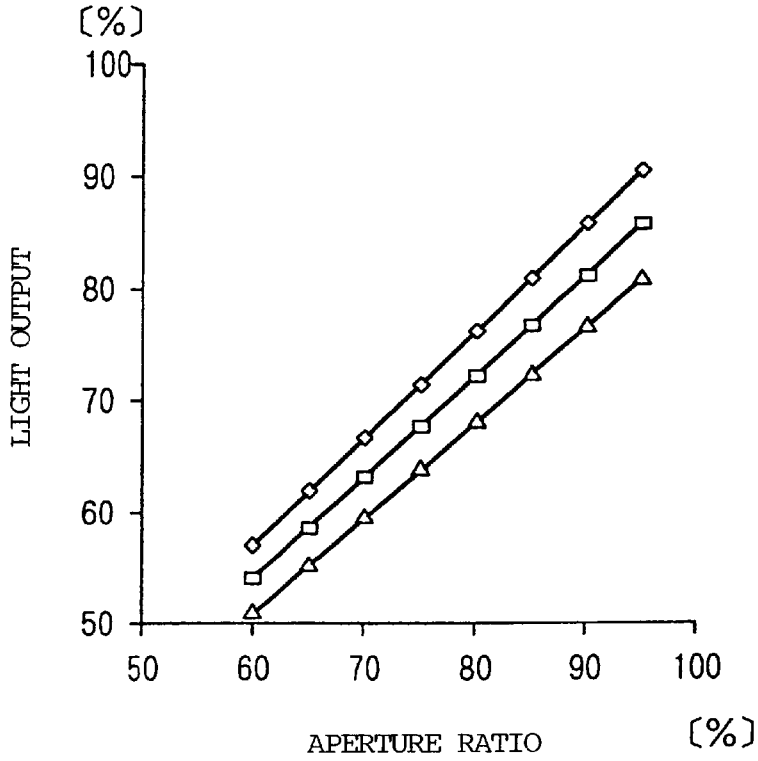
FIG. 21 is a characteristic diagram showing the relationship between the aperture ratio and transmittance of the discharge lamp.

As shown in FIGS. 19 and 20, the internal electrode 14 is formed on the inner wall surface of the bulb 12, and a fluorescent layer 19 is formed on the overall inner wall surface except the internal electrode 14. The external electrode 15 having a primary conductive portion 55 impervious to light and a transparent conductive film 56 electrically connected to the primary conductive portion 55 is formed on the outer wall surface of the bulb 12.

The primary conductive portion 55 is about 0.5 mm in width, for example, and is formed in such a way that a silver paste is printed directly onto the outer wall surface of the bulb 12, or, instead, the silver paste is first printed onto a transfer paper, and then is printed onto the outer wall surface of the bulb 12, and thereafter it is burned. The primary conductive portion 55 has a plurality of electrode parts 55*a* (three, in this embodiments) formed in the longitudinal direction of the bulb 12 and a plurality of connection parts 55*b* that are formed in the circumferential direction of the bulb 12 and that connect the electrode parts 55*a* with the same potential.

The transparent conductive film 56 is formed in such a way that the primary conductive portion 55 disposed on the outer wall surface of the bulb 12 is burned, and thereafter materials, such as ITO (Indium Tin Oxide), indium oxide, or tin oxide, are applied onto the outer wall surface of the bulb 12, and they are burned.

When a high-frequency voltage is applied between the internal electrode 14 and the external electrode 15, an electric current, which flows to an end side of the external electrode 15 through the lead wire 17, flows from an end side of each electrode part 55*a* to the other end side thereof, mainly in the primary conductive portion 55 that is lower in resistance than the transparent conductive film 56, and flows from each electrode part 55*a* to the whole of the transparent conductive film 56.

As a result, the electric current flows to the whole of the external electrode 15 on the outer wall surface of the bulb 12, and an electric discharge occurs between the internal electrode 14 and the external electrode 15. Electrons that run because of the electric discharge excite a discharge medium, such as xenon, enclosed in the bulb 12, and ultraviolet rays of 172 nm are emitted from xenon molecules. The fluorescent material of the fluorescent layer 19 formed on almost all the inner wall surface of the bulb 12 is excited by the ultraviolet rays, and the ultraviolet rays are converted into visible light. The visible light generated here passes through the transparent conductive film 56 of the entire bulb except the primary conductive portion 55, and is uniformly emitted to the outside of the bulb 12.

The electric discharge in the bulb 12 is carried out such that, in the case of DC pulse lighting, the electric discharge starts at a place where the internal electrode 14 and the external electrode 15 are closest to each other when actuated, and, as the bulb 12 is charged up, the electric discharge is gradually extended to a part of the external electrode 15 distant from the internal electrode 14.

In the thus constructed discharge lamp 11, the internal electrode 14 is disposed on the inner wall surface of the bulb 12, and the external electrode 15 is disposed on the exterior surface of the bulb 12. Therefore, only one tube wall of the bulb 12 lies between the internal electrode 14 and the external electrode 15, and the limitation of the electric current running between the internal electrode 14 and the external electrode 15 can be reduced, and the lamp voltage, such as the starting voltage or the discharge-maintaining voltage, can be reduced. Additionally, since the lamp input voltage and the frequency can be reduced, the emission of electromagnetic waves is lessened, and, therefore, the influence of noise upon other electronic equipment can be reduced.

Further, since the fluorescent layer 19 is formed on almost all of the inner wall surface of the bulb 12, and the external electrode 15 has the primary conductive portion 55 formed on the outer wall surface of the bulb 12 and the transparent conductive film 56 that is connected to the primary conductive portion 55 and formed on the outer wall surface of the bulb 12, the efficiency of converting ultraviolet rays into visible light by the fluorescent layer 19 can be improved, and the efficiency of the emission of light from the entire bulb except the primary conductive portion 55 on the outer wall surface of the bulb 12 to the outside of the bulb 12 can be improved, thus improving the luminous efficiency of the discharge lamp 11. Further, since both the primary conductive portion 55 and the transparent conductive film 56 are used as the external electrode 15, the electric resistance and loss of the external electrode 15 can be reduced.

Since the primary conductive portion 55 is constructed by connecting the plurality of electrode parts 55*a* to the plurality of connection parts 55*b*, the influence of the partial peeling of the transparent conductive film 56 or a high resistance part that might occur can be minimized.

FIG. 21 shows the relationship among the aperture ratio, excluding the primary conductive portion 55 on the outer wall surface of the bulb 12, the transmittance of the transparent conductive film 56, and the light output. In the figure, S1 denotes 80% transmittance, S2 denotes 90% transmittance, and S3 denotes 95% transmittance. There is a characteristic in which the light output becomes higher as the aperture ratio and the transmittance become higher.

Luminous efficiency that exceeds that of the discharge lamp having the aperture portion can be obtained if $0.6<S\cdot T$ where S is the aperture ratio of the outer wall surface of the bulb 12 excluding the primary conductive portion 55, and T is the transmittance of the transparent conductive film. That is, in the discharge lamp having the aperture portion, $0.6>S\cdot T$.

Herein, the aperture ratio S indicates the ratio of a surface area of the outer wall surface without the primary conductive portion 55 to a surface area (excluding an end surface) of the outer wall surface of the bulb 12. The transmittance T means diffuse-transmittance (i.e., ratio of all rays of light that pass through the transparent conductive film 56 when all rays of light emitted from the bulb 12 are defined as 1).

Figure 22:
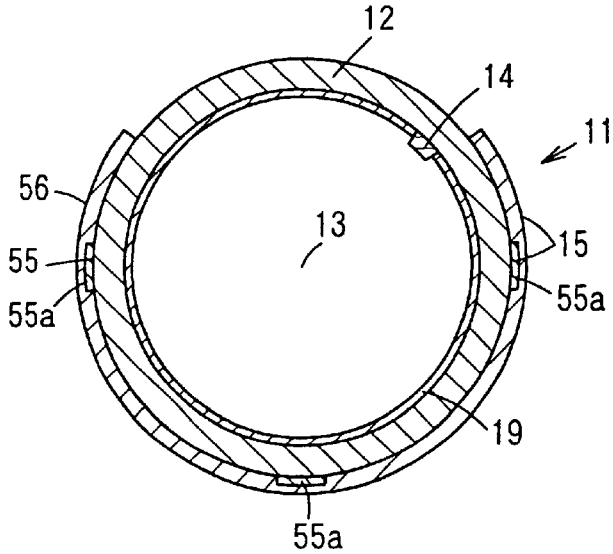
FIG. 22 is a cross-sectional view of a discharge lamp according to a fifteenth embodiment.

Next, a fifteenth embodiment of the present invention will be described with reference to FIG. 22. FIG. 22 is a cross-sectional view of a discharge lamp.

Without forming the transparent conductive film 56, an aperture is made corresponding to a part of the internal electrode 14. Thereby, an electric discharge in the bulb 12 is carried out such that, in the case of DC pulse lighting, the electric discharge starts at a place where the internal electrode 14 and the external electrode 15 are closest to each other when actuated, and, as the bulb 12 is charged up, the electric discharge is gradually extended to a part of the external electrode 15 distant from the internal electrode 14 that faces the external electrode 15, and thereafter a positive column that passes through the sectional center of the bulb 12 occurs between the internal electrode 14 and the part of the external electrode 15 that faces the internal electrode 14, and the percentage of the positive column in the discharge space 13 increases. The increase of the positive column allows xenon atoms, for example, enclosed in the discharge space 13 to excite efficiently so as to increase the emission of ultraviolet rays of 172 nm, and the increase of the ultraviolet rays heightens the excitation of the fluorescent layer 19 so as to improve the luminous efficiency.

Figure 23:
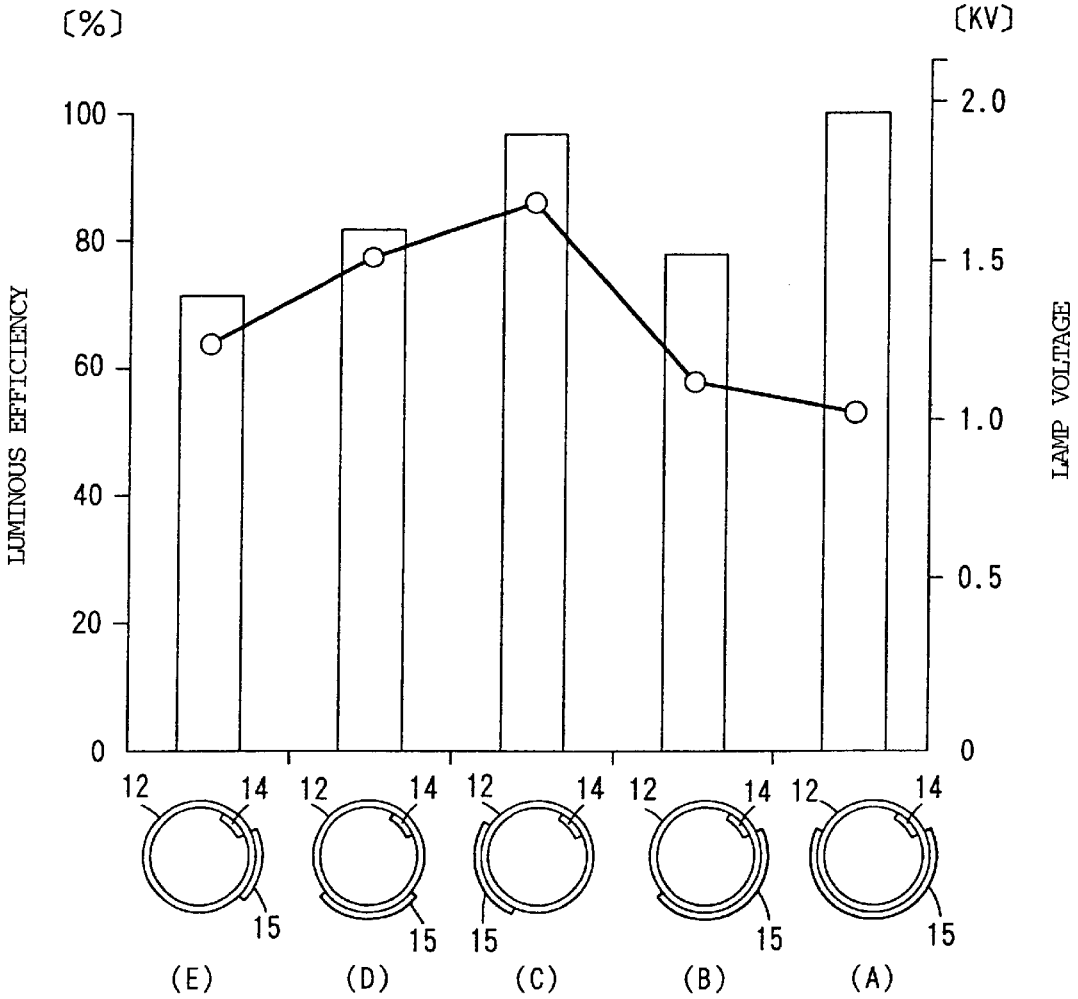
FIG. 23 is an explanatory drawing that shows a measurement result of luminous efficiency and lamp voltage when pulse lighting is carried out about the discharge lamps that differ from each other in the arrangement of the external electrode relative to the bulb.

FIG. 23 shows a measurement result of luminous efficiency and lamp voltage when the pulse lighting is carried out with respect to the discharge lamps of the respective embodiments in which the positions of the external electrodes 15 relative to the bulbs 12 are different from each other. In the figure, the luminous efficiency is indicated by the bar chart, and the lamp voltage is indicated by the line chart. The bulb of each discharge lamp measured herein is the same as in the first embodiment.

Referring to the discharge lamp 11 of (A), this lamp corresponds to the discharge lamp 11 of FIG. 1, and the external electrode 15 is formed excluding the aperture portion 18. In more detail, in the discharge lamp 11 of (A), the external electrode 15 is extended from the position where the external electrode 15 faces the internal electrode 14 with the sectional center of the bulb 12 therebetween to the position where the external electrode 15 overlaps with the internal electrode 14 with the tube wall of the bulb 12 therebetween. In this example, the luminous efficiency is highest, and the lamp voltage is lowest.

In the discharge lamp 11 of (B), the edge of the external electrode 15 opposite to the internal electrode 14 is made shorter than that of the discharge lamp 11 of (A). In this example, the luminous efficiency is lower than that of (A), and the lamp voltage is higher than that of (A).

Referring to the discharge lamp 11 of (C), this lamp corresponds to the discharge lamp 11 of FIG. 9, and the external electrode 15 faces the internal electrode 14 with the sectional center of the bulb 12 therebetween. In this example, the luminous efficiency is equally high to that of (A), but the lamp voltage is higher than that of (A).

In the discharge lamp 11 of (D), the external electrode 15 is closer to the internal electrode 14 than in the discharge lamp 11 of (C). In this example, both the luminous efficiency and the lamp voltage are lower than those of (C).

In the discharge lamp 11 of (E), the external electrode 15 is closer to the internal electrode 14 than in the discharge lamp 11 of (D), and the external electrode 15 overlaps with the internal electrode 14 with the tube wall of the bulb 12 therebetween. In this example, both the luminous efficiency and the lamp voltage are lower than those of (D).

The result obtained here was that there is a tendency for the luminous efficiency to increase in the case where the external electrode 15 faces the internal electrode 14 with the sectional center of the bulb 12 therebetween, and there is a tendency for the lamp voltage to decrease in proportion to the approach of the external electrode 15 to the internal electrode 14. Therefore, in the case where the external electrode 15 is extended from the position where the external electrode 15 faces the internal electrode 14 with the sectional center of the bulb 12 therebetween to the position where the external electrode 15 overlaps with the internal electrode 14 with the tube wall of the bulb 12 therebetween, as in the discharge lamp 11 of (A), the luminous efficiency can be kept higher, and the lamp voltage can be kept lower.

A measurement was also taken of the lamp voltage of a conventional discharge lamp in which a pair of external electrodes are formed on the exterior of a bulb which is the same as that of the discharge lamp used in this measurement. As a result, it was about 2.0 kV, which indicates that the discharge lamp of this embodiment is lower than the conventional one.

Figure 24:
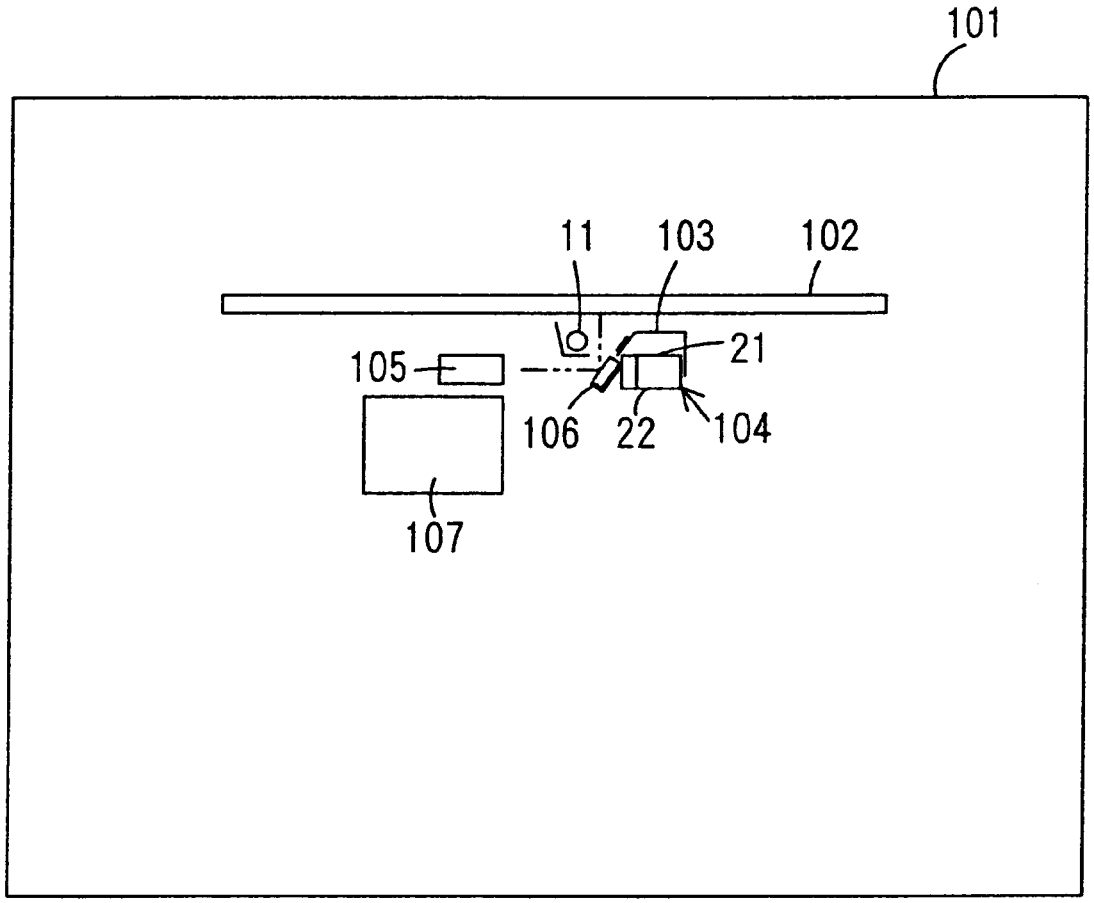
FIG. 24 is an explanatory drawing of a reader using the discharge lamp device.

FIG. 24 is an explanatory drawing of a reader using the discharge lamp device of the first embodiment shown in FIGS. 1 to 4.

A reader (i.e., image reading device) that is office automation equipment, such as a copying machine, an image scanner, or a fax machine, has a case body 101. A document setting table 102 made of glass is formed in the case body 101. A carriage 103 is disposed under the document setting table 102. The carriage 103 includes a light source unit 104 for reading the document and a light receiving means 105, such as a CCD, for reading, e.g., reds (R), greens (G), and blues (B) that moves while maintaining a fixed distance from the light source unit 104.

The light source unit 104 includes a discharge lamp device 21 for projecting a beam of light onto the document placed on the document setting table 102 and a mirror 106 for reflecting a beam of light reflected by the document placed on the document setting table 102 onto the light receiving means 105. The discharge lamp device 21 and the mirror 106 are mounted in the carriage 103.

A signal processing means 107 is further provided for processing an output signal of the light receiving means 105 so as to produce an image signal.

The light source unit 104 and the light receiving means 105, and the document setting table 102 scan relatively. In other words, the light receiving means 105 receives the reflected light from the document surface at a right angle with respect to a moving direction in a process in which any one of them or both of them move in an opposite direction.

In the thus constructed reader, a discharge lamp is needed that has a long electric-discharge path length extended in a main scanning direction perpendicular to a sub-scanning direction in which the light source unit 104 and the document setting table 102 scan relatively. Corresponding to this, the present invention can provide the discharge lamp device 21 using the discharge lamp 11 in which the electric-discharge path length is long, and the rising properties are excellent and highly effective, and, in addition, the lamp voltage is low.

The light emitting tube of the discharge lamp is not limited to the cylindrical bulb 12. A similar operational effect can be obtained even in the case of variously shaped bulbs, such as a sectionally square bulb or a sectionally polygonal bulb.

Industrial Applicability

The discharge lamp and the discharge lamp device of the present invention are superior in the rise properties of a beam of light, they are suitable for office automation equipment, such as a copying machine, an image scanner, or a fax machine, and they are applicable to various equipment that uses the projection of light or to illumination devices.

What is claimed is:

1. A discharge lamp, comprising:

a translucent tube-shaped light emitting body;

a discharge medium enclosed in the light emitting tube;

an internal electrode having a continuous part formed on an inner wall surface of the light emitting tube along a longitudinal direction of the light emitting tube and having a plurality of convex parts that project from said continuous part; and an external electrode disposed outside the light emitting tube along the longitudinal direction of the light emitting tube.

2. The discharge lamp of claim 1, wherein the internal electrode and the external electrode are placed so that at least part of them overlaps with each other with a tube wall of the light emitting tube therebetween.

3. A discharge lamp, according to claim 2, further comprising an aperture portion through which a beam of light generated by an electric discharge in the light emitting tube is emitted to the outside; and wherein the internal electrode is formed at one side of the aperture portion; and the external electrode is formed at a position excluding the aperture portion.

4. A discharge lamp, according to claim 1, further comprising an aperture portion through which a beam of light generated by an electric discharge in the light emitting tube is emitted to the outside; and wherein the internal electrode is formed at one side of the aperture portion; and the external electrode is formed at a position excluding the aperture portion.

5. A discharge lamp, according to claim 1, wherein:

the internal electrode and the external electrode have a relationship of facing to each other with a sectional center of the light emitting tube therebetween.

6. A discharge lamp, according to claim 1, wherein:

an auxiliary external electrode that is not electrically connected to the external electrode is disposed outside the light emitting tube and in the vicinity of the internal electrode.

7. A discharge lamp, according to claim 6, further comprising:

a lighting device for supplying electric power among the internal electrode, the external electrode, and the auxiliary external electrode of the discharge lamp when actuated and supplying electric power between the internal electrode and the external electrode after being actuated.

8. A discharge lamp, according to claim 1, wherein:

the external electrode is a transparent conductive film.

9. A discharge lamp, according to claim 8, wherein:

the external electrode has a primary conductive portion impervious to light, the primary conductive portion connected to the transparent conductive film, at least part of the primary conductive portion overlapping with the internal electrode with the tube wall of the light emitting tube therebetween.

10. A discharge lamp, according to claim 9, wherein:

$0.6<(S)\times(T)$, where S is an aperture ratio excluding the primary conductive portion of the outer wall surface of the light emitting tube, and T is the transmissivity of the transparent conductive film.

11. A discharge lamp, according to claim 1, further comprising:

a lighting device for lighting the discharge lamp with the external electrode of the discharge lamp as a grounding potential.

12. A discharge lamp, according to claim 11, wherein:

the lighting device applies a direct-current pulse voltage in which the internal electrode is set to be a cathode side.

13. A discharge lamp, comprising:

a translucent light emitting tube;

a discharge medium enclosed in the light emitting tube; and a pair of internal electrodes formed to face each other with a sectional center of the light emitting tube therebetween along a longitudinal direction of the light emitting tube, said internal electrodes having a continuous part and a plurality of convex parts that project from said continuous part.

14. A discharge lamp, according to claim 13, wherein:

an edge of at least one of the internal electrodes is ruggedly formed.

15. A discharge lamp, according to claim 13, wherein:

a dielectric layer is formed on the inner wall surface of the light emitting tube so as to cover the internal electrode.

16. A discharge lamp, according to claim 15, wherein:

the dielectric layer is made up of a plurality of layers different from each other in softening-point.

17. A discharge lamp, according to claim 15, wherein:

the dielectric layer is covered with an electron emitting layer.

18. A discharge lamp, comprising:

a tube-shaped light emitting body;

a discharge medium enclosed in the light emitting tube;

an internal electrode formed on an inner wall surface of the light emitting tube along a longitudinal direction of the light emitting tube; and an external electrode disposed outside the light emitting tube along the longitudinal direction of the light emitting tube, an auxiliary external electrode that is not electrically connected to the external electrode is disposed outside the light emitting tube and in the vicinity of the internal electrode, a carriage;

the discharge lamp mounted in the carriage; and light receiving means for receiving reflected light from a projecting surface from which a beam of light of the discharge lamp is projected.

* * * * *

UNITED STATES PATENT AND TRADEMARK OFFICE

CERTIFICATE OF CORRECTION

PATENT NO. : 6,614,185 B1
DATED : September 2, 2003
INVENTOR(S) : Kiyoshi Nishimura et al.

It is certified that error appears in the above-identified patent and that said Letters Patent is hereby corrected as shown below:

Title page,
Item [87], PCT Publication Date, delete "December 14, 2001" and substitute -- December 14, 2000 --.

Signed and Sealed this

Sixteenth Day of March, 2004

JON W. DUDAS
*Acting Director of the United States Patent and Trademark Office*